United States Patent [19]

Andersen

[11] 4,081,897

[45] Apr. 4, 1978

[54] METHOD OF MAKING AN ELECTRIC SWITCH

[75] Inventor: Edward O. Andersen, Rock Falls, Ill.

[73] Assignee: General Electric Company, Fort Wayne, Ind.

[21] Appl. No.: 672,851

[22] Filed: Apr. 2, 1976

Related U.S. Application Data

[62] Division of Ser. No. 477,828, Jun. 10, 1974, Pat. No. 3,968,468.

[51] Int. Cl.[2] ..... H01H 11/00

[52] U.S. Cl. ..... 29/622; 29/469.5

[58] Field of Search ..... 29/622, 469.5, 602 R; 337/99-107; 339/217 R, 218 R

[56] References Cited

U.S. PATENT DOCUMENTS

| | | | |
|---|---|---|---|
| 2,745,924 | 5/1956 | Coates | 29/622 |
| 3,230,607 | 1/1966 | Gelzer | 29/622 X |
| 3,243,554 | 3/1966 | Malone | 337/104 X |
| 3,361,883 | 1/1968 | Brassard, Jr. et al. | 29/622 X |
| 3,694,717 | 9/1972 | Prouty et al. | 337/102 X |
| 3,747,208 | 7/1973 | Rattan | 29/622 |
| 3,846,726 | 11/1974 | Hierholzer, Jr. et al. | 337/102 X |

*Primary Examiner*—Victor A. DiPalma
*Attorney, Agent, or Firm*—Joseph E. Papin

[57] ABSTRACT

A method of making an electrical switch having means adapted to be movable in response to heat supplied thereto between a pair of operable positions. The method includes the steps of: heating the movable means so as to effect its deflection in one of its operable positions and securing a part of the movable means while it is deflected in its one operable position; forming means adapted for heating the movable means with generally the same deflection thereof in the one operable position; and disposing the heating means so that it is generally spaced closely adjacent the movable means when it is deflected in its one operable position.

20 Claims, 9 Drawing Figures

METHOD OF MAKING AN ELECTRIC SWITCH

CROSS-REFERENCE TO RELATED APPLICATION

This application is a division of copending application Serial No. 477,828, filed June 10, 1974 now U.S. Pat. No. 3,968,468 issued July 6, 1976 and which application is incorporated herein by reference.

BACKGROUND OF THE INVENTION

This invention relates generally to electrical controls and in particular to a method of making an electrical switch.

In the past, various types of electric switches have been utilized as starting relays for various types of electric motors, such as for instance those known as permanent split capacitor types. Generally, these permanent split capacitor type motors have characteristics affording relatively high torque at normal running speeds and lower power consumption, but with the capacitor connected in the motor circuit, generally relatively poor starting torque is encountered. In the event of a locked rotor condition, as may be encountered in some motor applications or usages, rather high current may be drawn by the motor which may have a deleterious affect on the electric switch being utilized as a motor starting relay. This condition, of course, is believed to be considered as a disadvantageous or undesirable feature of at least some of the past electrical switches. Another one of the disadvantageous or undesirable features of at least some of these past electrical switches is believed to be that they were not automatically calibrated or at least they did not lend themselves readily to calibration. Another disadvantageous or undesirable feature of some of the past electrical switches is believed to be that they did not lend themselves to effect immediate restarting of the motor after a line or power interruption.

SUMMARY OF THE INVENTION

Among the several objects of the present invention may be noted the provision of a method of making an electrical switch which overcomes the aforementioned disadvantageous or undesirable features discussed hereinabove, as well as others with respect to the prior art; the provision of such method which affords a more efficient heat transfer between the bimetal strip and means for heating it; the provision of such method in which the bimetal strip and heater therefor generally have corresponding configurations; and the provision of such method which is simplistic economical and employs components easily assembled or manufactured. These as well as other objects and advantageous features of the present invention will be in part apparent and in part pointed out hereinafter.

In general, a method is provided in one form of the invention for making an electrical switch having means adapted to be movable in response to heat supplied thereto between a pair of operable positions. In this method, the movable means is heated so as to effect its deflection in one of its operable positions, and a part of the movable means is secured while it is deflected in its one operable position. Means adapted for heating the movable means is formed with generally the same deflection as the movable means in the one operable position thereof, and the heating means is disposed so that it is generally spaced closely adjacent to the movable means when it is deflected in its one operable position.

BRIEF DESCRIPTION OF THE DRAWINGS

Corresponding reference characters indicate corresponding parts throughout the several views of the drawings.

Figure 1:
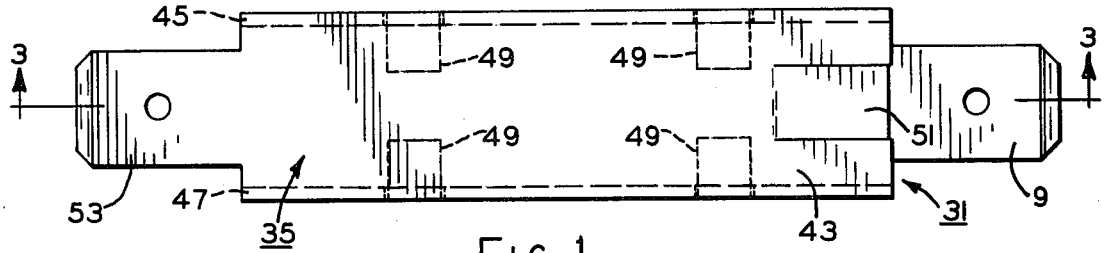
FIG. 1 is a plan view of an electrical switch.

The exemplifications set out herein illustrate the preferred embodiments of the invention and such exemplifications are presented merely for the purpose of disclosure and are not to be construed as limiting with respect to the invention in any manner.

DETAILED DESCRIPTION OF THE PREFERRED EMBODIMENTS

Referring now to the drawings in general, there is illustrated a method for calibrating a bimetal element or strip 1 of a type well known in the art with respect to means, such as an elongate base or support 3 of a suitable dielectric material, for mounting or supporting the bimetal strip (FIGS. 4–8). In this calibrating method, deflection of bimetal strip 1 at a selected temperature is determined with respect to mounting means or base 3, and at least a part, such as an integral depending flange or flange portion 5, of the bimetal strip is secured to the base while the bimetal strip is in its deflected position.

Figure 4:
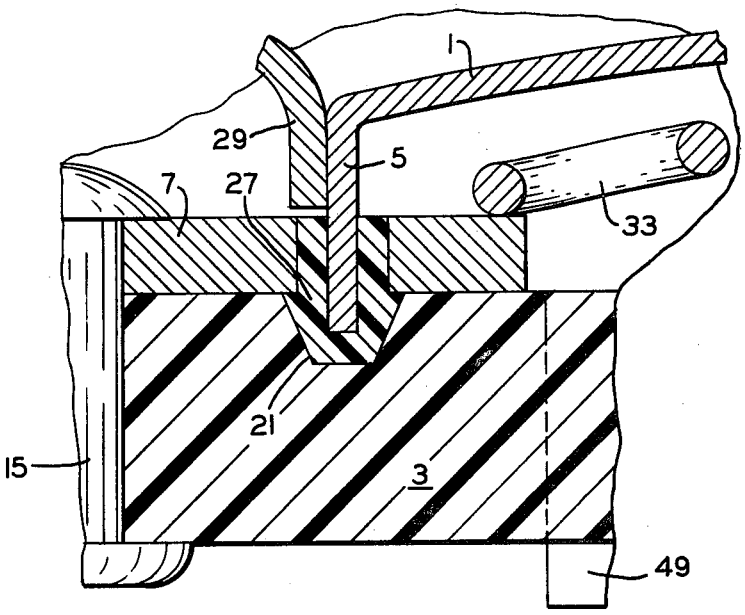
FIG. 4 is an enlarged fragmentory view taken from FIG. 3 showing the securement of the bimetal strip in the electrical switch.
Figure 5:
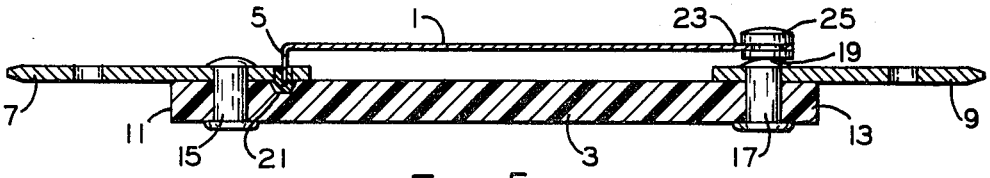
FIG. 5 is a sectional view illustrating the disposition of a bimetal strip with respect to a base portion of the electrical switch of FIG. 1 and teaching principles which may be utilized in a method of making the electrical switch in one form of the invention.

More particularly and with specific reference to FIG. 5, a pair of terminals 7, 9 are disposed on base 3 adjacent to a pair of opposite ends 11, 13 thereof, and means, such as a pair of rivets 15, 17, is provided for connecting the terminals to the base. While one of the heads 19 of rivet or connecting means 17 is illustrated as a contact which may be stationary, it is contemplated that a stationary contact which may also be stationary and separate from the rivet might be utilized within the scope of the invention. As shown in greater detail in FIGS. 2 and 4, recess means, such as an elongate recess or slot 21, is provided in base 3 extending through terminal 7, and the recess is disposed generally laterally of the base and terminal. Although recess 21 is shown in both base 3 and terminal 7, it is contemplated that the recess may be provided in only one of base 3 and terminal 7 within the scope of the invention. Bimetal strip 1 has a degree of inherent resiliency so that it may operate as a switch blade or spring arm, and in its relaxed or free state at room temperature, the bimetal strip is generally planar, as shown in FIG. 5. One of the pair of opposite end portions of bimetal strip 1 is generally comprised by its depending flange 5, and the other of the opposite end portions is comprised by a free or movable end 23 having a movable double contact 25 mounted thereon for making and breaking engagement with contact 19.

Bimetal strip 1 is initially disposed or positioned on base 3 with flange 5 disposed in recess 21 and movable contact 25 engaged with contact 19, as shown in FIGS. 4 and 5. Recess 21 and contact 19 comprise a pair of means for generally locating bimetal strip 1 on base 3. However, upon deflection of bimetal strip 1, as discussed in greater detail hereinafter, bimetal strip flange 5 may be slightly moved or displaced from its relaxed or at-rest position within recess 21, and the movable contact 25 may be slightly moved or displaced on contact 19. In either event, it may be noted that bimetal strip flange 5 remains generally located within recess 21, and movable contact 25 remains generally located on or in locating engagement with contact 19. A hardenable material, such as, in one form of the invention, an epoxy resin or other suitable thermal-setting plastic or bonding material 27, is placed or otherwise disposed in recess 21 for bonding, securing or fixedly assembling or connecting bimetal strip flange 5 therein against displacement. It is contemplated that material 27 may be placed in recess 21 either before or after bimetal strip flange is inserted thereinto.

Figure 6:
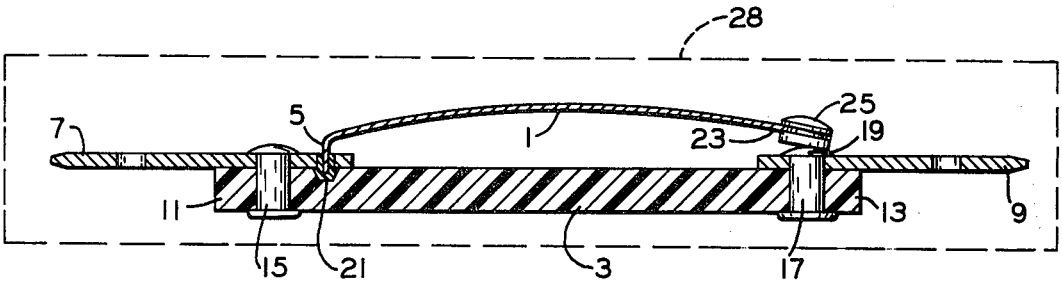
FIG. 6 is a sectional view showing the bimetal strip and base portion of the electrical switch of FIG. 5 positioned in an oven (designated in phantom lines) and illustrating a further step of the method.

When so assembled, bimetal strip 1 and base 3 may be placed into any suitable means, such as an oven 28 or the like indicated by the phantom lines in FIG. 6, for heating the bimetal strip to a selected calibrating temperature. This selected temperature is that which is necessary or which is desired for attaining full open position of the bimetal strip, as discussed hereinafter. As may be noted, when so heated, bimetal strip 1 deflects or assumes a predetermined curvature or generally arcuate configuration or shape as compared with its generally planar shape at room temperature (as seen in FIG. 5). When bimetal strip 1 attains its generally arcuate or predetermined configuration, flange 5 and movable contact 25 are moved slightly with respect to recess 21 and contact 19 on base 3 but remain generally located with respect thereto, as previously mentioned. Of course, material 27 will set or harden when subjected at least to the selected temperature not only to form a bond between bimetal strip flange 5 and the walls of recess 21 but also to maintain the bimetal strip flange in the deflected position it assumed within the recess when bimetal strip 1 attained its generally arcuate configuration.

Figure 7:
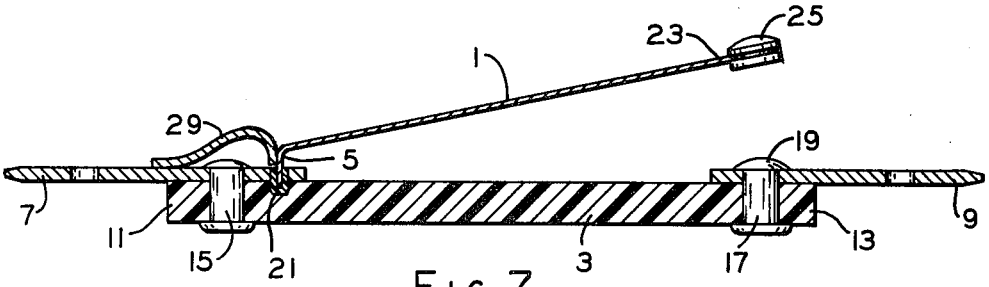
FIG. 7 is a sectional view showing the bimetal strip assembled to the base portion of the electrical switch upon the cooling thereof subsequent to removal from the oven of FIG. 6.

In this manner, the permanent disposition of bimetal strip flange 5 within recess 21 determines the stroke or travel of bimetal strip 1. The full stroke or travel may be the movement of bimetal strip 1 between its full open position when subjected to the selected temperature, i.e. with movable contact 25 in making engagement with contact 19, and its relaxed or at-rest position when cooled to room temperature, as shown in FIG. 7. At this time, an electrical lead or connection, such as a pig tail 29 or the like, may be connected between terminal 7 and bimetal strip 1 generally adjacent flange 5 thereof by suitable means, such as soldering for instance. In view of the foregoing, it may be noted that bimetal strip 1 is now calibrated to attain a predetermined deflection or generally arcuate configuration at the selected temperature, and when subsequently heated to such selected temperature, the bimetal strip will travel to engage movable contact 25 with contact 19.

Figure 2:
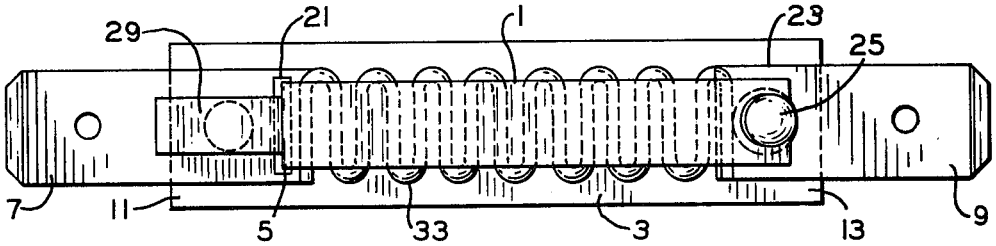
FIG. 2 shows the electrical switch of FIG. 1 with its top or cover removed.
Figure 8:
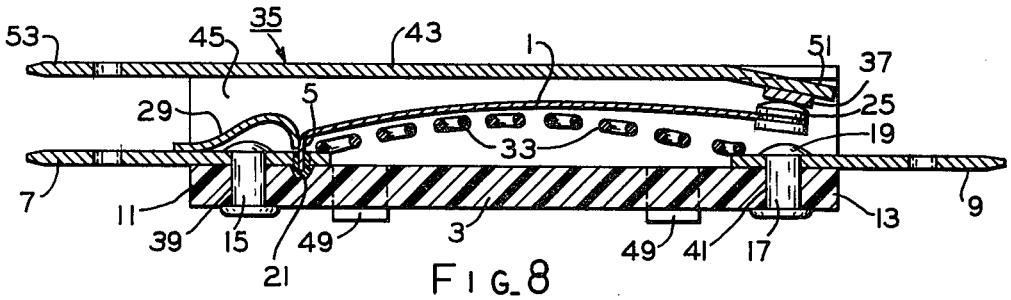
FIG. 8 is a sectional view showing a completed electrical switch with a cover mounted to the base portion similar to that shown in FIG. 3 but with the bimetal strip in a normal (or cooled) one of its operable positions.

Referring now again to the drawings in general, a method in one form of the invention is illustrated for making an electrical switch 31 having means, such as bimetal strip 1, adapted to be movable in response to heat supplied thereto between a pair of operable positions. In this making method, the curvature or generally arcuate configuration of movable means or bimetal strip 1 is determined in a selected one of the operable positions, i.e. with movable contact 25 in making engagement with contact 19, as discussed hereinbefore with respect to the calibration of the bimetal strip. Means, such as an electrical resistance heater or serpentine-shaped resistance wire 33, for heating bimetal strip 1 is formed with generally the same predetermined curvature or generally arcuate shape as the bimetal strip in the one selected operable position thereof (FIGS. 2 and 8). Resistance heater or heating means 33 is then disposed or assembled in electrical switch 31 so that it is generally spaced closely adjacent bimetal strip 1 when it is in its one selected operable position.

More particularly, after the curvature of bimetal strip 1 has been determined by the calibrating method, as previously discussed, resistance heater 33 is bent or otherwise so formed to a generally arcuate configuration so as to have a curvature generally corresponding to that of the bimetal strip in its one selected operable position. It is also contemplated that the resistance heaters may be preformed within the scope of the invention. After resistance heater 33 is shaped, it is positioned closely adjacent bimetal strip 1 with the opposite ends of the resistance heater engaged with terminals 7, 9, and the opposite ends of the resistance heater may now be electrically connected by suitable means, such as soldering or the like for instance, to the terminals. It may be noted that providing generally the same arcuate configuration to bimetal strip 1 and resistance heater 33 assures good heat transfer therebetween and particularly when the bimetal strip is in its one selected operable position.

A cover or top 35 for electrical switch 31 may now be predeterminately positioned on base 3 so that another contact 37 which may be stationary and provided on the cover is oppositely disposed in predetermined spaced relation with respect to contact 19, as seen in FIG. 8. Base 3 and cover 35 generally comprise a housing for switch 31. Upon assembly of cover 35 with base 3, the engagement of contact 37 with movable contact 23 bends or stresses bimetal strip 1 from its relaxed or at-rest position. This stressing of bimetal strip 1 serves to predetermine the temperature at which the bimetal strip will be actuated in response to heat supplied thereto by resistance heater 33 to break the engagement of movable contact 25 from contact 37, as discussed hereinafter.

Referring now in general to FIGS. 1–4 and 8, electrical switch 31 is provided with means, such as bimetal strip or resilient switch blade 1, adapted to be movable in response to heat supplied thereto between a pair of circuit controlling positions, i.e. when movable contact 25 is in making and breaking engagement with contact 37, respectively, as discussed hereinafter. Means, such as resistance heater 33, is energized in response to power applied thereto for heating bimetal strip 1 to effect movement thereof between the circuit controlling positions, and the bimetal strip is also movable to another operable position for shunting the heating means or resistance heater upon the occurrence of a certain condition.

Figure 3:
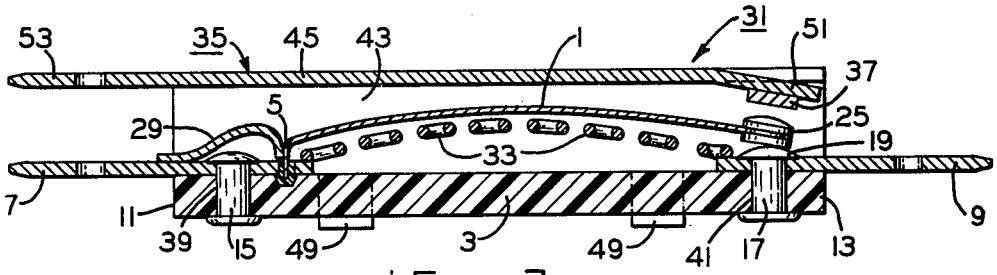
FIG. 3 is a sectional view taken along lines 3—3 of FIG. 1 with a bimetal strip of the electrical switch shown in a displaced (or heated) one of its operable positions.

More particularly, base 3 is provided with a pair of openings 39, 41 adjacent opposite ends 11, 13 of the base, and rivets 15, 17 are insert through the base openings into retaining engagement with terminals 7, 9, FIGS. 3 and 8. Of course, various fixturing (not shown) may be utilized to assemble base 3 and terminal 7, 9 with rivets 15, 17 for riveting over the heads thereof. It is contemplated that suitable means, other than rivets 15, 17, may be employed for securing terminals 7, 9 to base 3 at opposite ends 11, 13 thereof. After bimetal strip 1 has been secured to base 3, as discussed in detail above cover 35 is removably secured to the base. Cover 35 is formed of metal having good electrical conduction properties and includes an elongate top 43 integrally interposed between a pair of depending side walls 45, 47. The free end of side walls 45, 47 rest upon or engage base 3 adjacent opposite marginal edges thereof, and means, such as a plurality of tabs 49, are spaced along the side wall free ends for displacement preventing engagement with the base. Tabs or engagement means 49 are respectively bent or otherwise displaced into engagement with base 3. The rightward end of cover top 43 (as seen in FIGS. 1 and 3) is lanced at 51, and the lanced part 51 is depressed so that contact 37, which is carried on the lanced part, may be predeterminately spaced from contact 19 on base 3, as previously mentioned. The leftward end of cover top 43 comprises another terminal 53 disposed in spaced apart overlaying relations with terminal 7 on base 3, and terminal 53 is, of course, electrically connected with contact 37 through cover 35. It is contemplated that a cover may be provided of material other than metal with a metallic connection electrically interconnecting between terminal 53 and contact 37 within the scope of the invention.

Figure 9:
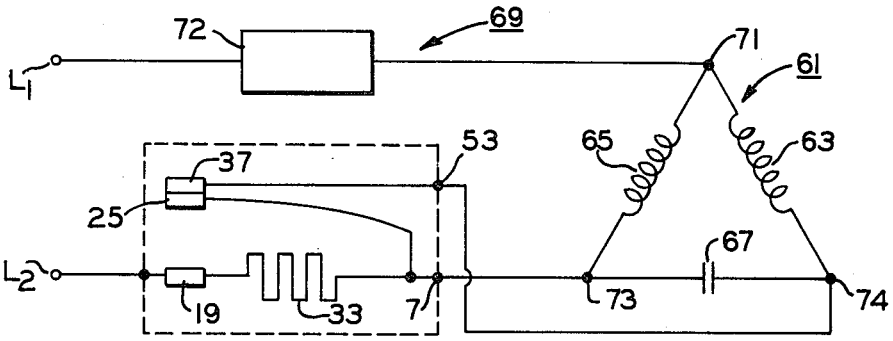
FIG. 9 is a schematic diagram showing a circuit for an electric motor.

In FIG. 9, another method is illustrated for energizing a dynamoelectric machine, such as an electric motor illustrated schematically at 61, having a start or auxiliary winding or winding means 63 and a run or main winding or winding means 65 connected in parallel circuit relation and a capacitor 67 adapted to be selectively connected in series circuit relations with the start winding. In this method, means, such as bimetal strip 1 adapted to be thermally actuated, is biased into one circuit controlling position, i.e. in making engagement with contact 37, for shunting capacitor 67 from circuit relation with start winding 63 wherein relatively high current is passed through both run winding 65 and the start winding during an initial or start-up period of motor energization. The relatively high current is utilized for heating thermally actuated means or bimetal strip 1 and effecting actuation thereof to another circuit controlling position, i.e. disengaged from contact 37 for connecting capacitor 67 in series circuit relation with start winding 63 wherein motor 61 is thereafter energized at a normal running current. Means, such as resistance heater 33, for heating bimetal strip 1 is shunted from circuit relation with run winding 65 and the series connected capacitor 67 and start winding 63 in the event motor 61 draws current predeterminally in excess of the normal running current thereof.

There is also shown in FIG. 9 a circuit 69 for an electric motor 61. In this circuit, means, such as electrical switch 31, is provided for switching the circuit relation of capacitor 67 upon energization of heater 33. Switch 31 includes means, such as a resistance heater 33, in series circuit relation with both start winding 63 and run winding 65 during an initial period of motor energization for generating heat, and means, such as bimetal strip 1, is provided for shunting capacitor 67 from circuit relation with start winding 63 during the initial period of motor energization. Shunting means or bimetal strip 1 is operable generally in response to the generated heat to effect switching of capacitor 67 into series circuit relation with start winding 63 thereby to terminate the initial period of motor energization and thereafter energize motor 61 at its normal running speed. Bimetal strip 1 is also operable generally in response to an increase in the generated heated in excess of a predetermined value for shunting heat generating or resistance heater 33 in the event of the occurrence of a high current condition passing through at least the run winding 65 and the resistance heater which may deleteriously affect it.

More particularly, a motor terminal 71 is connected with a line or power terminal L1, and a motor protector switch 72 of a type well known in the art may, if desired, be electrically interposed between the motor terminal and the line terminal. Another motor terminal 73 is connected with terminal 7 of electrical switch 31 which has its terminal 9 connected with another line or power terminal L2. To complete the description of circuit 69, the motor terminal 74 is connected with terminal 53 of electrical switch 31.

OPERATION

Assuming that bimetal strip 1 of electrical switch 31 is in its circuit controlling or operable position making movable contact 25 with contact 37, it is apparent that capacitor 67 is shunted from circuit relation with either of start winding 63 or run winding 65 of motor 61, as shown in FIGS. 8 and 9. With capacitor 67 so shunted, a rather high current is drawn through both start winding 63 and run winding 65 when motor 61 is connected across the line, i.e. across line terminals L1, L2, by actuation of an on-off type motor starting switch (not shown) to effect the initial or start-up period of motor energization. The rather high starting current across start winding 63 flows therefrom to terminal 53 of electrical switch 31 through cover 35 to contact 37. Since contacts 25, 37 are in making engagement, as mentioned above, the relatively high current flows therefrom through bimetal strip 1, pigtail 29, terminal 7, resistance heater 33 and terminal 9 to line terminal L2. At the same time, the rather high starting current across run winding 65 flows therefrom through terminal 7 of electrical switch 31, resistance heater 33 and terminal 9 to line terminal L2. As may be noted, the relatively high starting current across both start winding 63 and run winding 65 is applied to resistance heater 33 of switch 31. Therefore, resistance heater 33 is very quickly energized to generate a relatively large amount of heat. In this manner, the quick generation of a relatively large amount of heat commensurate with the relatively large starting current is supplied or transmitted directly to bimetal strip 1 due to the relatively close disposition or spacing of the resistance heater with the bimetal strip.

Of course, bimetal strip 1 thermally responsive or actuated, and when the generated heat attains a value great enough to cause the bimetal strip to overcome its prestressed or pretensioned biased for urging movable contact 25 into making engagement with contact 37, the bimetal strip will be actuated to deflect or pivot generally about its flange 5 toward base 3 thereby breaking engagement of the movable contact with contact 37. In this manner, the circuit from start winding 63 through bimetal strip 1 and resistance heater 33 of switch 31 is interrupted thereby to terminate the initial or start-up period of energization for motor 61. It may be noted that the initial period of motor energization for starting is relatively short. This is due to the relatively high starting current drawn by start and run windings 63, 65 and the application thereof to resistance heater 33 which effects rather quick energization thereof for generating heat great enough to cause movement of bimetal strip 1 at a high rate of speed for opening contacts 25, 37. Of course, when contacts 25, 37 are so disengaged, bimetal strip 1 is disposed in its other circuit controlling or operable position.

As may be recalled, capacitor 67 had been shunted from circuit relation with both start and run windings 63, 65 due to making engagement of contacts 25, 37; however, upon breaking disengagement of the movable contact from contact 37, capacitor 67 is now placed in series circuit relation with start winding 63 and in parallel circuit relation with run winding 65. By placing capacitor 67 in this circuit arrangement with start and run windings 63, 65, the current drawn by motor 61 is reduced to a normal running value, and the motor will now operate at its normal running speed since the initial or start-up period is terminated, as discussed above.

With motor 61 now energized to run at its normal speed, the reduced amount of current drawn by the motor is applied to electrical switch 31 through a circuit thereof generally comprised by terminals 7, 9 and resistance heater 33 to line terminal L2. Of course, the watts or heat generated by resistance heater 33 is reduced commensurate with the reduction of current drawn by motor 61 at its normal running speed. However, it may be noted that the deflection of bimetal strip 1 toward base 3 not only brings the bimetal strip into closer spaced relation with resistance heater 33 but also the predetermined curvature or corresponding generally arcuate shapes of the bimetal strip and resistance heater effects a more effective transmission of the heat generated by the resistance heater to the bimetal strip. It therefore follows that bimetal strip 1 in its other circuit controlling position may be generally unaffected by the reduction of heat generated by resistance heater 33 since the bimetal strip is now closer to the resistance heater and the curvature of the bimetal strip more generally approximates that of the resistance heater. In its other circuit controlling or operable position, bimetal strip 1 may be generally disposed so that its movable contact 25 is between contacts 19, 37, i.e. disengaged from each. However, bimetal strip 1 may hunt between its other circuit controlling position disengaging movable contact 25 from both contacts 19, 37 and another operable position engaging the movable contact with contact 19. This hunting action of bimetal strip 1 is believed not to affect the performance of motor 61 energized at its normal running speed. If the watts or heat generated by resistance heater 33 is of a value great enough to effect deflection of bimetal strip 1 to its operable position making engagement of movable contact 25 with contact 19, resistance heater 33 is then shunted from circuit relation. When resistance heater 33 is so shunted, current will take the path of least resistance flowing in a circuit through electrical switch 31 from terminal 7 through pigtail 29, bimetal strip 1, contacts 25, 19 in making engagement to terminal 9 and therefrom to line terminal L2. Of course, this hunting action of bimetal strip 1 may be effected by many different variables in circuit 69, the power circuit connected therewith, or in the apparatus driven by motor 61 to increase the current drawn thereby to a value in excess of the normal running current. The shunting of resistance heater 33 by bimetal 1 upon the making engagement of contacts 25, 19 protects the resistance heater from the deleterious affects, such as fusing and burning out or the like, upon the aforementioned predetermined or emergency conditions occasioned by current drawn by motor 61. Of course, the increased current flowing through bimetal strip 1 may heat it to a value great enough to maintain it in its operable position making engagement of contacts 25, 19.

When the condition of the aforementioned high current draw by motor 61 is alleviated, bimetal strip 1 will cool slightly returning to its other circuit controlling position disengaging movable contact 25 from contact 19 thereby to terminate shunting of resistance heater 33. In this manner, resistance heater 33 is once again placed in circuit relation between start and run winding 63, 65 of motor 61 and line terminal L2 to effect re-heating or re-energization of the resistance heater. The heat once again generated by resistance heater 33 acts on bimetal strip 1 which is responsive thereto to remain in its other circuit controlling position, i.e. its mid-position wherein movable contact 25 is disengaged from both contacts 19, 37.

It may be noted that the shunting or shorting out of resistance heater 33 in the event of a high current condition when motor 61 is energized at its normal running speed, as discussed above, acts to limit the temperature rise of electrical switch 31. This temperature rise limiting feature of electrical switch 31 also assures fast closure or re-engagement of movable contact 25 with contact 37 when motor 61 is taken off the line by operator actuation of the on-off switch (not shown) for breaking circuit 69 between line terminals L1, L2.

In view of the foregoing, it is now apparent that a novel method of making an electric switch is provided meeting the objects and advantages set out hereinbefore, as well as others. It is contemplated that changes may be made by those having ordinary skill in the art as to the precise connections, arrangements, shapes, in details of the constructions, as well as the precise steps for practicing the method, set forth herein for purposes of illustration and disclosure without departing from the spirit of the invention or the scope thereof which is set out by the claims which follow.

I claim:

1. A method of making an electrical switch having means adapted to be movable in response to heat supplied thereto between a pair of operable positions comprising the steps of:

a. heating the movable means so as to effect its deflection into a predetermined curvature in one of the operable positions and securing an integral part of the movable means against movement while the movable means is deflected in the predetermined curvature thereof in the one operable position;

b. forming a means adapted for heating the movable means with a curvature generally complementary to the predetermined curvature of the movable means in the one operable position; and c. disposing the heating means closely adjacent to the movable means so that the complimentary curvature of the heating means generally approximates the predetermined curvature of the movable means only when the movable means is deflected into the one operable position.

2. The method as set forth in claim 1 comprising the preliminary step of placing the movable means in its one operable position with a pair of opposite portions of the movable means disposed with respect to a pair of spaced means for respectively locating the opposite portions.

3. The method as set forth in claim 2 wherein the heating and securing step comprises subjecting the movable means to at least a selected temperature so as to effect the deflection of the movable means into its predetermined curvature while the movable means is in the one operable position thereof with respect to the spaced locating means.

4. The method as set forth in claim 3 wherein the subjecting step comprises moving the opposite portions to displaced positions located with respect to the locating means upon the deflection of the movable means into its predetermined curvature while the movable means is in the one operable position.

5. The method as set forth in claim 4 wherein the heating and securing step further comprises mounting one of the opposite portions permanently in its displaced position and located with respect to one of the spaced locating means while the other of the opposite portions is in its displaced position and located with respect to the other of the spaced locating means.

6. The method as set forth in claim 1 wherein the heating and securing step includes placing the movable means within means for heating the movable means so as to effect its deflection into the predetermined curvature thereof.

7. The method as set forth in claim 6 wherein the heating and securing step comprises permanently interconnecting an integral portion of the movable means to means for mounting the movable means while the movable means is deflected into the predetermined curvature while the movable means is in the one operable position.

8. A method of making an electrical switch having a bimetal element and means for mounting it comprising the steps of:

a. disposing the bimetal element in a generally free state on the mounting means;

b. heating the bimetal element to at least a selected temperature to effect deflection of the bimetal element from its generally free state to a predetermined deflected configuration with respect to the mounting means and permanently securing an integral part of the bimetal element to means associated with the mounting means for receiving the integral part of the bimetal element while it is in the predetermined deflected configuration thereof; and c. assembling a means adapted for electrical energization so as to transmit heat to the bimetal element onto the mounting means with the electrical energization means spaced closely adjacent the bimetal element and forming the electrical energization means so as to have a predetermined configuration generally complimenting the predetermined configuration of the bimetal element only when the bimetal element is deflected into its predetermined configuration.

9. The method as set forth in claim 8 wherein the heating and securing step comprises preheating to generally the at least selected temperature means for heating the bimetal element and the mounting means and placing the mounting means with the bimetal element in its generally free state thereon so as to be subjected to the heat of the heating means.

10. The method as set forth in claim 8 wherein the disposing step comprises placing a pair of opposite portions of the bimetal element with respect to a pair of means predeterminately spaced apart on the mounting means for generally locating the opposite portions, the integral part of the bimetal element comprising one of the opposite portions.

11. The method as set forth in claim 10 wherein the heating and securing step comprises respectively effecting movement of the opposite portions to deflected positions with respect to the locating means when the bimetal element is deflected toward its deflected configuration.

12. The method as set forth in claim 11 wherein the heating and securing step further comprises permanently connecting in fixed relation to the mounting means the one opposite portion in its deflected position and located with respect to one of the locating means while the other of the opposite portions is in its deflected position and located with respect to the other of the locating means.

13. The method as set forth in claim 8 comprising the preliminary step of disposing a hardenable material between the mounting means and the integral part of the bimetal element, the hardenable material becoming hardened when subjected to the at least selected temperature for effecting the permanent securing of the integral part of the bimetal element during the heating and securing step.

14. The method as set forth in claim 13 wherein the mounting means includes a recess for receiving the integral part of the bimetal element and the hardenable material.

15. The method as set forth in claim 8 wherein the assembling step comprises electrically connecting the electrical energization means with means on the mounting means adapted for connection with a power source.

16. A method of making an electrical switch having a bimetal element on means for supporting it, the supporting means having at least one electrical terminal and at least one contact, a recess in at least one of the supporting means and the at least one electrical terminal, the bimetal element having another contact thereon and an integral flange portion spaced from the another contact, the method comprising the steps of:

a. disposing the bimetal element on the supporting means with the another contact engaging the at least one contact and the integral flange portion within the recess and placing in the recess a hardenable material adapted to harden upon subjection to a selected temperature;

b. subjecting the bimetal element and the hardenable material to the selected temperature to effect movement of the bimetal strip toward a deflected configuration so that the integral flange portion assumes a deflected position within the recess with the another contact engaging the at least one contact and securing the integral flange portion in its deflected position within the recess upon the hardening of the hardenable material therein in response to the selected temperature; and c. connecting a means for electrical energization to transmit heat to the bimetal element in electrical circuit relation between the at least one electrical terminal and the at least one contact so that the electrical energization means is generally spaced closely adjacent the bimetal element when the bimetal element is in its deflected configuration.

17. The method as set forth in claim 16 wherein the connecting step comprises forming the heat transmitting means so that it has a configuration generally complimentary to that of the bimetal element in its deflected configuration.

18. The method as set forth in claim 16 comprising the additional step of assembling a cover into the supporting means.

19. The method as set forth in claim 18 where the cover includes a third contact for engagement with the another contact, and another electrical terminal connected in circuit relation with the third contact.

20. A method of making an electrical switch having a bimetal switch blade, means for supporting the switch blade, a terminal associated with the supporting means, recess means in at least one of the terminals and the supporting means, and a contact on the supporting means spaced from the recess means, the method comprising the steps of:

a. disposing the bimetal switch blade on the supporting means so that one of a pair of opposite portions of the bimetal switch blade is engaged with the contact and so that the other of the opposite portions of the bimetal switch blade extends into the recess means with a hardenable material adapted to harden generally at a preselected temperature also disposed in the recess means in association with the other opposite portion;

b. heating the bimetal switch blade to the selected temperature to effect deflection of the bimetal switch blade toward a a predetermined configuration so that the one opposite portion assumes a deflected position on the contact and the other opposite portion assumes a deflected position in the recess means and securing the other opposite portion in its deflected position in the recess means upon the hardening of the hardenable material in the recess means in response to the selected temperature; and c. assembling a means for electrical energization so as to transmit heat to the bimetal switch blade onto the supporting means in circuit relation with the contact and the terminal and forming the electrical energization means with a predetermined configuration adapted to compliment that of the bimetal switch blade only when the bimetal switch blade is deflected into its predetermined configuration.

* * * * *